US005746369A

United States Patent [19]

McDermott

[11] Patent Number: 5,746,369

[45] Date of Patent: May 5, 1998

[54] PACKAGING CARTON WITH PERFORATIONS FOR DISPENSING MOUTH

[76] Inventor: Virginia B. McDermott, 216 Williamsburg Rd., Ardmore, Pa. 19003

[21] Appl. No.: 696,155

[22] Filed: Aug. 13, 1996

Related U.S. Application Data

[60] Provisional application No. 60/015,641 Apr. 19, 1996.

[51] Int. Cl.[6] ..... B65D 5/10

[52] U.S. Cl. ..... 229/120.03; 221/45; 221/63; 229/120.32; 229/121; 229/122

[58] Field of Search ..... 229/120.03, 121, 229/122, 122.1, 120.19, 120.21, 120.28, 120.37; 221/45, 63

[56] References Cited

U.S. PATENT DOCUMENTS

| | | | |
|---|---|---|---|
| 1,791,094 | 2/1931 | Albert | 229/120.03 |
| 1,899,772 | 2/1933 | Richardson | 229/120.03 |
| 3,275,220 | 9/1966 | Hubbard | 229/120.32 |
| 3,954,220 | 5/1976 | Foster | 229/120.03 |
| 4,170,325 | 10/1979 | Pawlowski et al. | 206/526 |
| 4,382,526 | 5/1983 | Stone . | |
| 5,049,710 | 9/1991 | Prosise et al. | 229/120.32 |
| 5,203,457 | 4/1993 | Garcia . | |
| 5,443,204 | 8/1995 | O'Donnell et al. . | |
| 5,447,253 | 9/1995 | Williams . | |
| 5,482,185 | 1/1996 | McNaughton . | |

FOREIGN PATENT DOCUMENTS

| | | |
|---|---|---|
| 0 469 320 | 2/1992 | European Pat. Off. . |
| 41 05 169 | 8/1992 | Germany . |

*Primary Examiner*—Stephen P. Garbe
*Attorney, Agent, or Firm*—Richard C. Litman

[57] ABSTRACT

An improved paperboard carton including a dispensing mouth which when separated from the surrounding carton forms a dispensing mouth for dispensing single units of a row of units, the units typically being individually-wrapped and thinly profiled packages, such as teabags, sweetener packages and the like. The improvement comprises a series of perforations which have been added to create the mouth panel on a known carton pattern. The perforations permit release of the mouth panel from one of either of two end walls whereby a hinged mouth panel and an opening for single dispensing of the unit results. When two mouth panels are provided, the panels are located in positions diagonally opposed to one another on the opposing end walls. The end walls are defined as being the walls which bound each end of a row of arrayed units, whereby the face of the package is parallel with the end walls. The perforations may be placed on the end wall in a relationship to the face of the package which permits the fixed portion of the end wall from which the mouth opening has been released to slightly impede the top edge of the package and prevent it from falling out the carton. Moreover, the mouth panel remains hinged in place and does not permit a proximate package to easily escape, unless manual application of force to pull the package from the carton is applied.

7 Claims, 4 Drawing Sheets

PACKAGING CARTON WITH PERFORATIONS FOR DISPENSING MOUTH

CROSS REFERENCE TO RELATED APPLICATION

This application claims the benefit of Provisional patent application Ser. No. 60/015,641 filed Apr. 19, 1996.

BACKGROUND OF THE INVENTION

1. Field of the Invention

The present invention relates to an improved paperboard carton including a panel which when separated from the surrounding carton by means of a perforation line forms a dispensing mouth for dispensing individually-wrapped, thinly profiled packages, such as teabags, sweetener packages and the like, arranged in rows of any orientation and number.

2. Description of the Invention

In the ordinary consumer's household, particularly in the kitchen, storage space is typically at a premium. Kitchen cabinets are generally built having an upper and lower shelf, but when filled with packaged food staples, large amounts of vertical space is wasted. Therefore, low, horizontally-expansive packages are wasteful of such precious space and often are not suitable for simply dispensing the product when oriented in a vertical position.

Such packaging is exemplified by the packaging of teabags in a wide, but low, paperboard carton consuming a large surface area when oriented with its cover such that the teabags are accessible. Often a rectangular paperboard box is provided for holding 48 teabags in two rows, the cover accessing all 48 bags at once. Similarly, larger quantities of bags, such as 150 bags, are stored in three rows; obviously, any number of rows holding equal numbers of a larger equally divisible number of teabags is possible. Although the packaging provides a convenient purchase quantity for the ordinary consumer, it fails to consider additional conveniences equally important to the consumer.

The use of such packaging cartons is also historically popular among manufacturers because of the economic benefits associated with producing the cartons, such as the ease and speed of printing, ease and speed of die cutting a pattern from a continuous sheet material for assembly of a carton, light weight materials reducing shipping costs, and so on. Paperboard cartons and the like have long been used by manufacturers to package, as a unit, a plurality of individually wrapped packages for single-serving use by consumers. Typically, the individually wrapped or contained packages are uniform in size and are thus stacked or placed during the packaging process in rows into the carton. The carton is then ultimately placed into the stream of commerce as a unit for sale and distribution of the plurality f individually wrapped packages.

To further improve the utility of such cartons, it is also known that perforation lines can be provided during the assembly process to define a variety of features, such as an access to the interior of the carton such that single-serving products are more conveniently dispensed for use once the package has reached the ultimate consumer. The access opening is often placed at the base of the carton such that gravity acts to subsequently feed a next single-serving container to the access opening as the prior container is removed. A well known example of such a dispensing paperboard container is the "12-pack" cola or beer can carton, wherein the carton may be opened by pulling a panel forward when broken from the surrounding carton along a perforation line to result in an unobstructed mouth opening through which a cylindrical can is able to closely pass. U.S. Pat. No. 5,482,185 issued Jan. 9, 1996 to McNaughton illustrates such a can carton in conjunction with apparatus for catching containers dispensed from its opening.

Taking advantage of gravity is a common practice to allow feeding of the individually wrapped packages as well. Other examples of paperboard packaging for dispensing stacked articles, particularly having a mouth opening in the lower portion of a wall, are abundantly found in the prior art. In each such package, the position of the mouth opening on the carton wall depends upon the relationship between 1) the individually wrapped article housed within the carton and 2) the direction of gravity relative to the mouthed wall, in order to permit each individually wrapped package to fall towards the mouth opening.

For example, U.S. Pat. No. 4,382,526 issued May 10, 1983 to Stone describes a carton having an infolded lip panel on the front wall of a vertical shaft which at its base provides an upward incline for support of a stack of articles; access is had by pulling the bottommost article in the stack outwardly up the incline through the mouth opening allowing gravity to feed subsequent articles vertically downward to the mouth opening. Conversely, German Publication No. 4,105,169 published Aug. 27, 1992 by Bromund describes a shipping box which can be used as a dispenser for products housed in tubes, wherein the tubes are fed gravitationally down an incline inside the box to a mouth of a width at least as long as the tube. Likewise, U.S. Pat. No. 5,443,204 issued Aug. 22, 1995 to O'Donnell et al. describes a paperboard carton for multiple elongated articles stored on an incline within the carton; however, a die cut panel in an end wall is removed to provide ready access to the contents such that they may be removed endwise.

However, each of these configurations fail to consider the previously noted limitations of storage needs of an ordinary consumer. Typically, the height of a carton is maximized to accommodate the maximum number of individually wrapped articles for dispensing by gravity, thereby minimizing the need for multiple openings and multiple columns. However, most kitchen cabinets fail to accommodate with ease vertical boxes over 9 inches in height. Therefore, an need exists for a carton which minimizes the amount of horizontal surface space used, maximizes the vertical space used within the parameters of ordinary kitchen cabinet dimensions, and yet allows the convenient dispensing of the article held within the carton. This need must be balanced with a manufacturer's need to take advantage of existing packaging processes and successful types of functional package design.

Finally, it should be noted that containers for dispensing individually wrapped articles which containers are not intended as retail or unit packaging are also known. U.S. Pat. No. 5,447,253 issued Sep. 5, 1995 to Williams describes a refillable, rigid, gravity-fed condom dispenser having a slanted floor. European Patent Office Publication No. 469,320 published Feb. 5, 1992 by inventor Dave Coffin describes a point of sale dispenser for packaged razor blades. In the interest of full disclosure, U.S. Pat. No. 5,203,457 issued Apr. 20, 1993 to Garcia describes an improved wrapper for dispensing planar articles. However, none of these prior art devices are directed at packaging cartons intended for sale to the consuming public.

None of the above inventions and patents, taken either singly or in combination, is seen to describe the instant invention as claimed.

SUMMARY OF THE INVENTION

The present invention relates to an improved paperboard carton including a panel which when separated from the surrounding carton by means of a perforation line forms a dispensing mouth for dispensing often individually-wrapped and thinly profiled packages, such as teabags, sweetener packages and the like, (hereinafter referred to as "units"), arranged in rows of any orientation and number (hereinafter referred to as "arrayed units"). A known pattern for assembly of the carton is used as a basis for description of the improved carton according to the preferred embodiment, the carton being exemplary of cartons of a type used to package arrayed units and the improvement comprising a series of perforations added to create a mouth panel. The improvement further comprises the relative position of the series of perforations to the walls of a carton. End walls are defined as being the walls which bound each end of the arrayed units, whereby the face of a unit is generally parallel with and facing the end walls. Side walls are defined as being the walls which bound the sides of the arrayed units, whereby the face of a unit is generally perpendicular with the side walls.

The perforations are provided on, and therefore permit release of a mouth panel from, one, either or both of two end walls against which a face of a unit initially abuts when packaged as arrayed units. Breaking the perforations results in the release of a hinged mouth panel and an opening for single dispensing of the unit. When two mouth panels are provided, the panels may be located in positions diagonally opposed to one another on the opposing end walls.

The perforations are placed on an end wall in a relationship to the face of a unit when packaged in an array which permits the fixed wall portion of the end wall (from which the mouth opening has been released) to slightly impede the top edge of the unit to prevent it from falling out of the carton. The perforations may be provided in the end wall as a linear series, an arcuate series, or any other series of perforations permitting removal of the panel from the end wall. Moreover, the mouth panel remains hinged in place creating a replaceable barrier before a unit proximate to the opening, thereby preventing the proximate unit to easily escape by force of gravity unless a slight manual force to pull the package from the carton is applied.

Accordingly, it is a principal object of the invention to provide a carton for packaging of individually dispensed units wherein perforations defining a mouth opening for dispensing a single units of arrayed units packaged in the carton.

It is another object of the invention to provide an improved carton having an opening which enables the contents to be removed from the carton through an opening of a predetermined shape defined by a series perforations in a wall of the carton.

It is a further object of the invention to provide an improved carton which provides a mouth panel opening in an end wall relative to the carton floor surface.

Still another object of the invention is to provide a dispenser mouth opening in cartons otherwise used for packaging arrayed units.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to an improved paperboard carton including a dispensing mouth which when separated from the surrounding carton forms a dispensing mouth for dispensing individually-wrapped, thinly profiled units, such as teabags, sweetener packages and the like, arranged in rows of any orientation and number. It is to be understood that for purposes of the following description, the units need only be generally uniform in size and arrayed in rows in a unit packaging container and, therefore, a unit may have any dimension suitable for individual serving and may be dispensed according to the present invention. Furthermore, the unit makes up no part of the claimed invention. Therefore, the shape of the unit as described by the preferred embodiment is not to be construed as limiting the present invention. For ease of description however, each unit may have two opposing faces seamed to one another along its peripheral edges, as present in teabag wrappers and sugar packets; as seen in the Figures each unit is identified as T.

Figure 1:
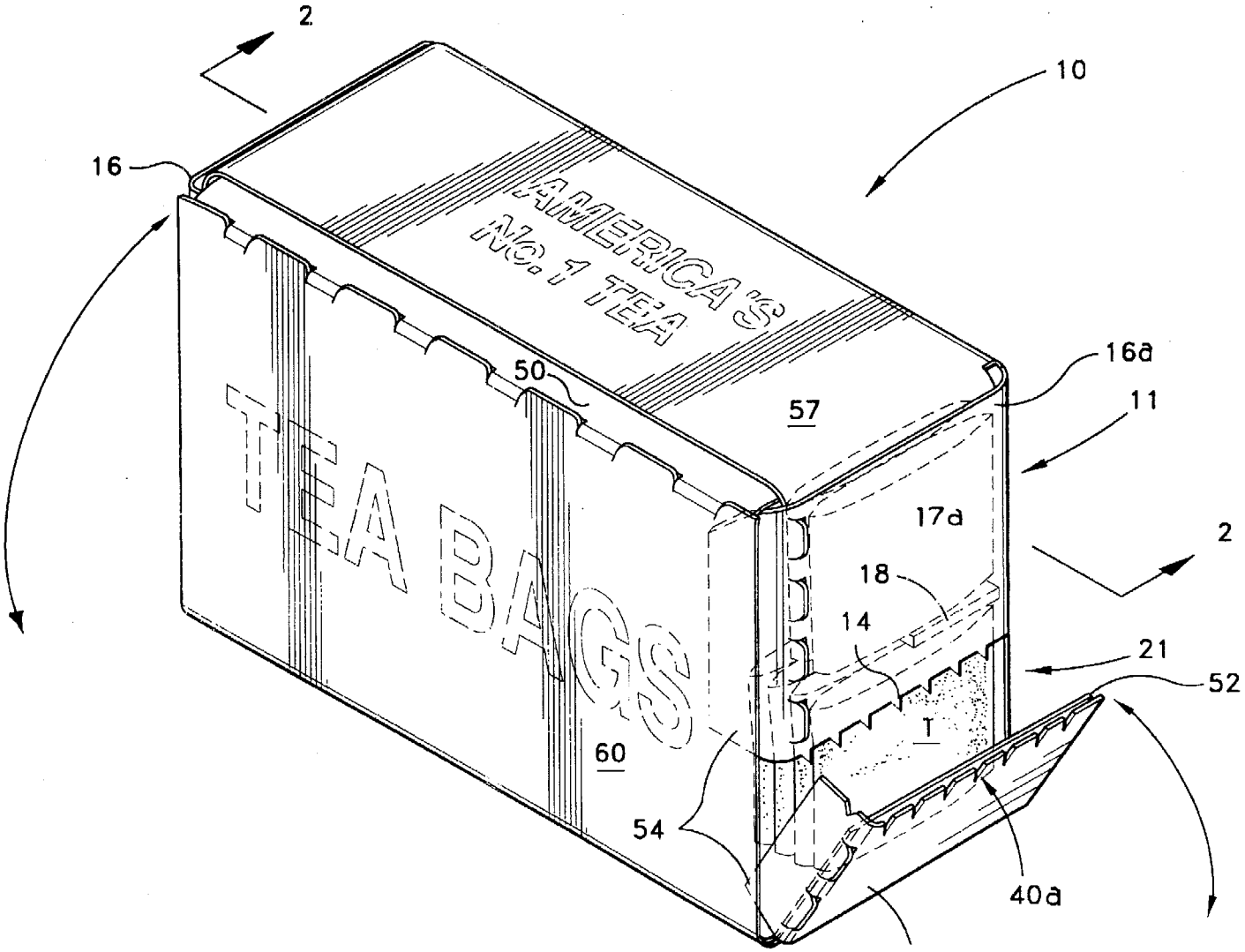
FIG. 1 is an environmental perspective view of the dispensing carton showing the mouth panel separated from a carton wall.

Similarly, a known method for assembly of the carton is used as a basis for description of the improved carton 10 according to the preferred embodiment shown in each of the Figures. The improvement comprises a series of perforations which has been added to create one or more mouth panels 12, 12*a*. The known assembly method should be understood to be exemplary of cartons of the type used to package arrayed units, and not limiting of the present invention. Each carton has a pair of end walls which are defined as being the walls which bound each end of the arrayed units T, whereby the face of an end unit $T_1$ is generally parallel with and facing the end wall. The end walls 16,16*a* of the preferred embodiments as shown in the Figures are defined as being the walls which bound each end of the first row 11 and second row 21 of teabags T, whereby the face of the teabag, as shown in FIG. 1, is parallel with the end walls 16,16*a*. A side wall 57 is shown in FIG. 1; side walls are defined as being each wall which bound the sides of the arrayed units, whereby the face of a unit is generally perpendicular with the side walls.

The improvement comprises a series of perforations 40,40*a* provided on one or both of two end walls 16,16*a* against which a face of a unit $T_1$ initially abuts when packaged within arrayed units. Breaking the perforations 40*a* results in the release of a hinged mouth panel and an opening for single dispensing of the unit T. When two mouth panels (12 or 12*a* as shown in the preferred embodiment) are provided, the panels may be located in positions diagonally opposed to one another on the opposing end walls 16,16*a*.

Figure 2:
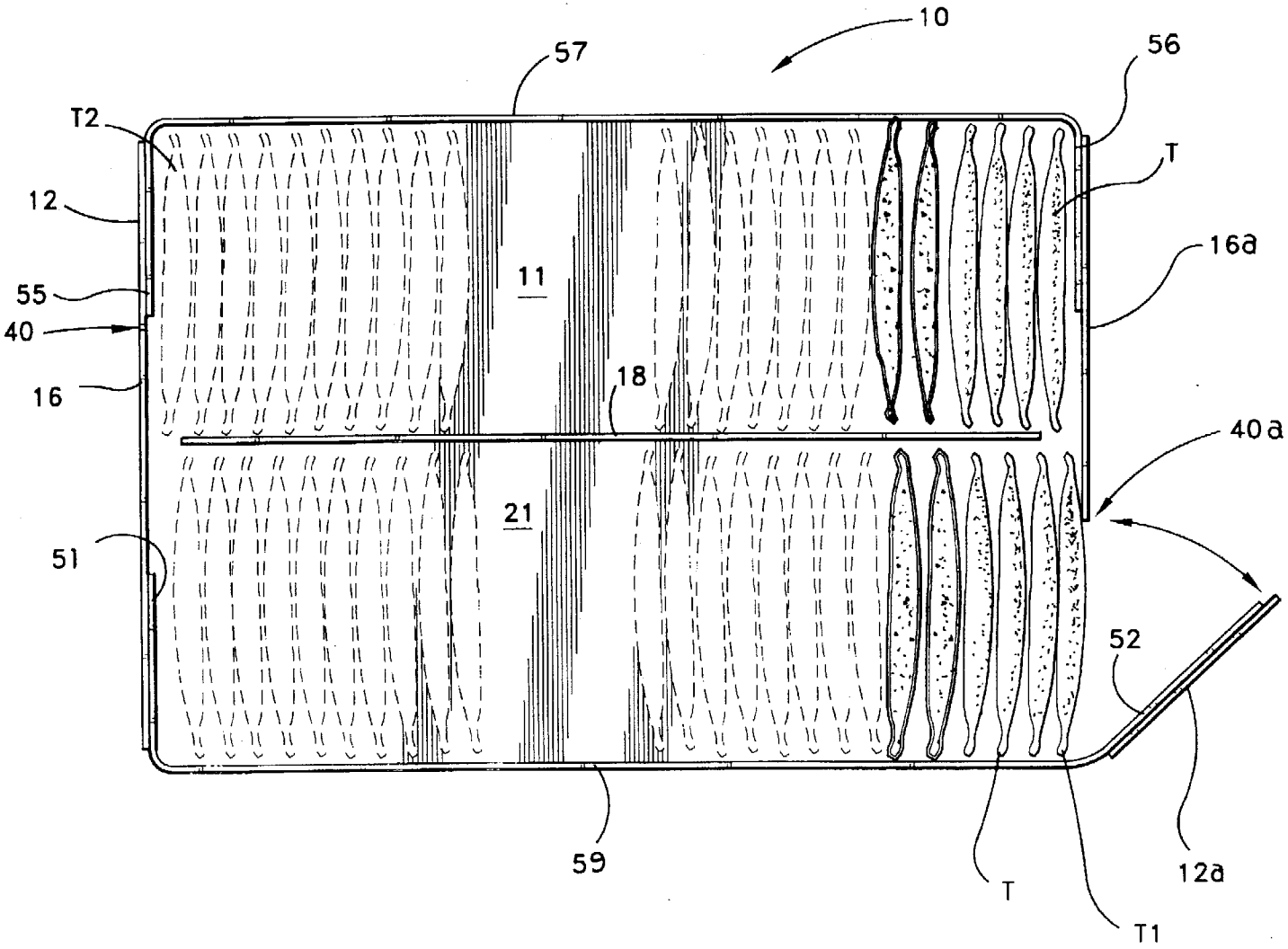
FIG. 2 is a cross-section of the dispensing carton drawn along lines 2—2 of FIG. 1. The contents of the carton are shown in both cross-section and elevational side view for clarity; phantom lines represent repeated units of the contents.

Referring now specifically to FIG. 1, the preferred embodiment of the improved carton 10 is shown having a mouth panel 12*a* in an opened state, as applied to a carton containing a plurality of individually wrapped, uniformly sized teabags T aligned in a horizontal array (as best appreciated from FIG. 2). The carton 10 is divided into a first row 11 and a second row 21, which rows are defined by the placement of a divider wall 18 between each row of teabags T. A series of teeth 14 in the end wall 16 of the carton represent the perforations 40*a* which permit release of the mouth panel 12*a* from the end wall 16*a*.

The perforations 40*a* are placed on an end wall in a relationship to the face of the unit T which permits the wall portion 17*a* (remaining from the end wall 16*a* from which the mouth panel 12*a* has been released) to slightly impede the top edge of the unit T to prevent it from falling out of the carton 10. As suggested by FIG. 1 and FIG. 4, the perforations 40*a* may be provided in the end wall as a linear series, an arcuate series, or any other line of perforations permitting removal of the panel from the end wall. Moreover, the mouth panel 12*a* remains hinged in place in front of the unit, thereby preventing a proximate unit $T_1$ to easily escape by force of gravity unless a slight manual force to pull the package from the carton 10 is applied. However, if desired the mouth opening created by the panel 12*a* could be enlarged or diminished in size.

Figure 3:
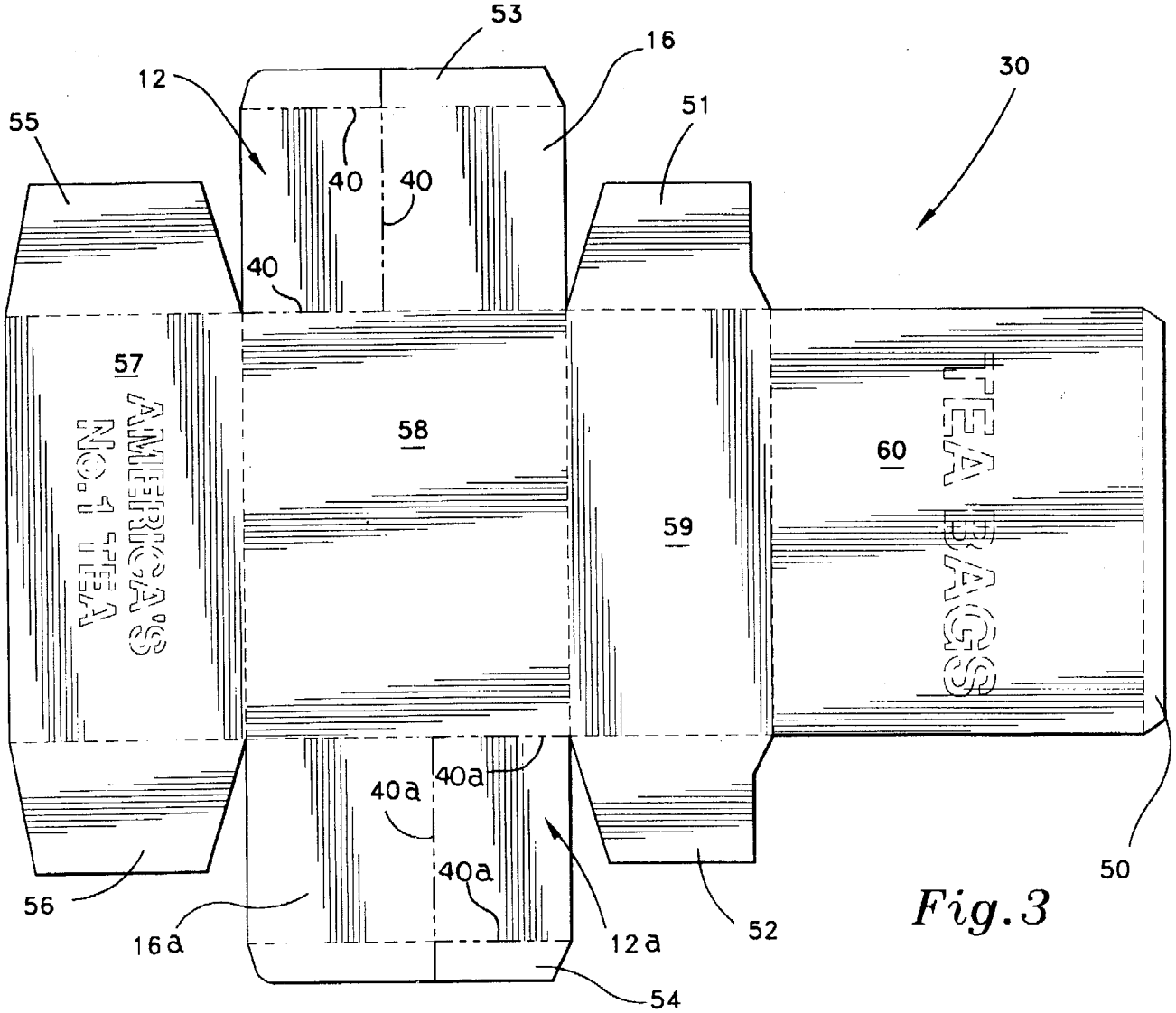
FIG. 3 is a plan view of the blank for forming the dispensing carton showing perforation lines for two mouth panels.

The carton 10 is shown disassembled in FIG. 3 as carton blank 30. A known method for assembly of the carton is used as the basis for the improved carton 10, the improvement comprising a series of perforations 40*a*,40 which have been added to create the mouth panels 12*a*,12. The carton blank 30 can be cut from a unitary sheet material, such as paperboard or a perforable sheet material having like qualities. The blank 30 is assembled such that, if more than one mouth panel 12,12*a* is provided on the single patterned sheet material 30, each mouth panel may be resultingly located in a position diagonally opposed to the other panel 12,12*a* on an end wall 16,16*a* of the carton 10, as can be best appreciated from FIG. 2. However, the mouth panels may be included at various positions and in varying sizes on each of the end panels.

As can be noted from FIG. 3, the carton blank 30 comprises a plurality of tabs 50,51,52,53,54,55,56 extending from four central panels 57,58,59,60. Panel 60 comprises the front cover 60 as shown in FIG. 1 which allows access to all the teabags T at one time. Such front cover in known cartons generally allow access to the entirety of the contents at one time and are inconvenient for single unit dispensing. The end walls 16,16*a* depend laterally from panel 58. As can be understood from a comparison of FIG. 1 and FIG. 2, when the carton 10 is assembled, the end walls 16,16*a* are attached to panel 60 by an adhesive or other fastener (not shown) and panel 59 forms the floor of the known carton.

The perforations 40*a* maybe positioned relative to the tab 52 such that the tab 52 does not interfere with the perforation line 40*a*, being located slightly above the end of the tab 52, for ease of breaking the end wall 16*a* into each the mouth panel 12*a* (being integrally hinged to panel 58) and the remaining fixed portion of end wall 16*a*. The same relationship exists relative to tab 55, as shown in FIG. 2. However, as noted previously, the perforations may be placed anywhere suitable for dispensing the unit T from the end wall 16,16*a*.

Moreover, the perforation line 40*a* may be further positioned such that the end wall 16*a* is divided into substantially unequal portions, wherein the mouth panel 12*a* has dimensions slightly smaller than the dimensions of the face of the teabag T. Moreover, the perforation line 40*a* may be positioned inwardly of the edges of end panel 16*a* to form a lip or flange (not shown) which restricts the sides of the mouth opening when formed. As can be observed from FIG. 1 and FIG. 2, the teabag $T_1$ in row 21 proximate to the mouth panel 12*a* is not permitted by the mouth panel to easily escape (even without the lip or flange), unless manual application of force to pull the teabag from the carton 10 is applied. This feature is in part due to the slightly resilient quality of the paperboard which allows the mouth panel 12*a* to form an incline at the point of attachment between end wall 16*a* and panel 59, which may be bent to an open state. The same relationships and features are present in end wall 16 corresponding in a like manner to the teabag $T_2$ in row 21 proximate to mouth panel 12.

Figure 4:
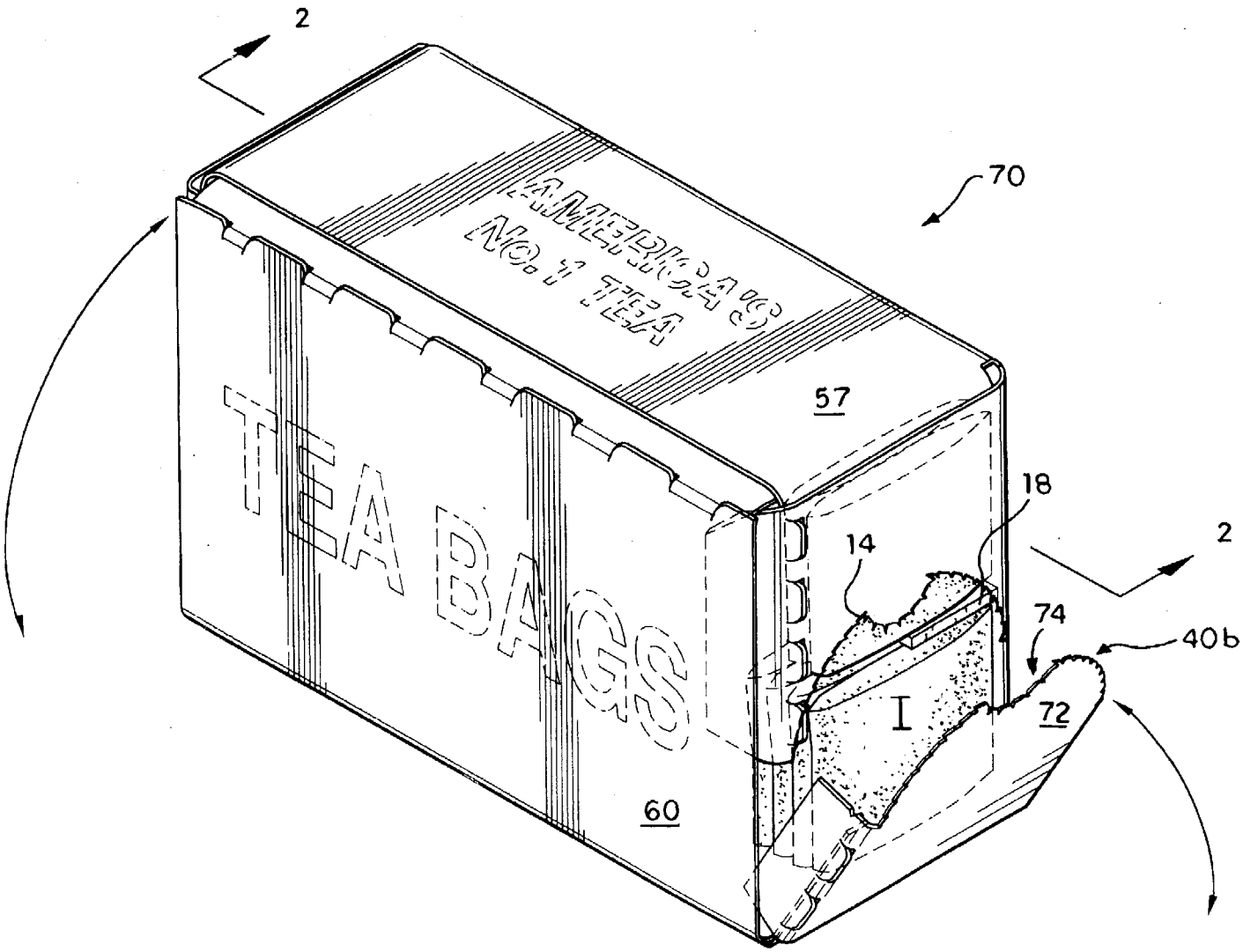
FIG. 4 is an environmental perspective view of an alternative embodiment of the dispensing carton showing a differently shaped mouth panel separated from a carton wall.

The desired orientation of the mouth panel 12*a* to the teabags T and the panels and tabs of the carton 10 is achieved by configuring of the perforations 40*a* as shown in the carton blank 30 of FIG. 3. In the preferred embodiment, a perforation line 40*a* extends across end panel 16*a* from the outward edge of the panel tab 54 to the edge formed by the junction of panel 58 and end panel 16*a*. At such junction, a right angle in the perforation line 40*a* extends the perforations to the nearest corner between panels 58 and 59. A similar configuration for perforation line 40 of panel 16 is provided on panel 16 in a location diagonally opposite to mouth panel 12*a*, where the perforation line 40 extends across end panel 16 from the outward edge of the panel tab 53 to the edge formed by the junction of panel 58 and end panel 16. At such junction, a right angle in the perforation line 40 extends the perforations to the nearest corner, in this instance being between panels 58 and 57. As previously suggested, the perforations 40,40*a* may be provided in the end walls 16,16*a* as a linear series, an arcuate series, or any other line of perforations permitting removal of the panel from the end wall. Referring now to FIG. 4, a second embodiment 70 of the present invention can be seen to have a larger mouth panel 72 defined by the perforation line 40*b*, the line being arcuate with a finger cutout 74.

As used in the prior art, the divider panel 18 is often used as free-floating divider between rows 11 and 21. However, the divider 18 may also be attached to either one or both the end walls 16,16*a* or one or both panels 58,60 by a fastening means. If so attached, the operation dispensing a teabag from either of the mouth panels 12,12*a* is improved by providing a floor to retain the teabags in an orderly array.

Finally, it is noted that although the preferred embodiment is directed at a carton capable of being subdivided into two rows for receiving teabags, other embodiments can be envisioned in which the cavity is further subdivided. Nevertheless, the addition of any number of rows in no way effects the relationships as discussed herein in so far as rows of horizontally-oriented arrays of units should be present. It is also emphasized that although teabags are used as an exemplary article of an individually-wrapped, uniformly sized, thinly-profiled single-serving content unit, other products such as sugar, artificial sweeteners, razor blades, etc., are also known to be so packaged. Therefore, it is to be understood that the present invention is not limited to the sole embodiment described above, but encompasses any and all embodiments within the scope of the following claims.

I claim:

1. A packaging carton for individually dispensing units comprising:

a parallelepiped carton having a floor, a multiplicity of walls including two end walls, and a cover opposing said floor when closed, said carton defining a cavity containing a plurality of units arranged into a first row and a second row, said first row having a first end unit adjacent one of said end walls and said second row having a second end unit adjacent the other of said end wall, said cavity having a divider between said first row and said second row; and a series of perforations provided in at least one of said end walls, said perforations defining a panel hinged to said floor, said panel dimensioned to be slightly lesser in dimension than one of said units.

2. The carton according to claim 1, including a second series of perforations provided in the other of said end walls, said at least two end walls, each said panel diagonally disposed to one another in an opposing said second series of perforation defining a second panel hinged to said cover, said second panel dimensioned to be slightly lesser in dimension than one of said units.

3. The carton according to claim 1, wherein said series of perforations defines a finger cutout provided in said panel.

4. The carton according to claim 1, wherein said series of perforations is arcuate.

5. A packaging carton for individually dispensing units comprising:

a parallelepiped carton having a first wall and a second wall, said first wall and said second wall being approximately equal in dimensions and further being opposed and aligned in parallel planes, said carton further having a third wall and a fourth wall being approximately equal in dimensions to one another but of substantially lesser dimensions than said first wall and said second wall, said third wall and said fourth wall further being opposed and aligned in parallel planes to one another and disposed at right angles both to said first wall and said second wall, said carton further having a fifth wall and a sixth wall being approximately equal in dimensions to one another, said fifth wall and said sixth wall having a width substantially less than that of said first wall and said second wall, said fifth wall and said sixth wall further being opposed and aligned in parallel planes to one another and disposed at right angles to both said first wall and said second wall and to both third wall and said fourth wall, all said walls being attached to one another along at least one edge of each said wall thereby defining an enclosed cavity wherein said first wall is attached to said fourth wall along one edge only thereby defining a hinged cover to said cavity, said cavity being divided into at least two rows by at least one divider wall longitudinally disposed in a plane between said fifth wall and said sixth wall; and, a series of perforations provided across the width of said fifth wall and along the junction of said fifth wall and said second wall to a nearest corner formed by the junction of three walls, thereby defining a removable first panel in said fifth wall hinged to said fourth wall.

6. The packaging carton for individually dispensing units according to claim 5, further comprising a series of perforations provided across the width of said sixth wall and along the junction of said sixth wall and said second wall to a nearest corner formed by the junction of three walls, thereby defining a second panel in said fifth wall hinged to said third wall diagonally opposed to said first panel.

7. The carton according to claim 5, wherein said divider is affixed to at least one of the group of walls consisting of the second wall, fifth wall and sixth wall, thereby forming an immobile partition between the rows.

* * * * *